US010190731B2

(12) United States Patent
Huang et al.

(10) Patent No.: US 10,190,731 B2
(45) Date of Patent: Jan. 29, 2019

(54) LAMPHOLDER AND LUMINAIRE

(71) Applicants: BOE TECHNOLOGY GROUP CO., LTD., Beijing (CN); BOE OPTICAL SCIENCE AND TECHNOLOGY CO., LTD., Suzhou, Jiangsu (CN)

(72) Inventors: Pingping Huang, Beijing (CN); Hao Su, Beijing (CN); Yue Li, Beijing (CN)

(73) Assignees: BOE TECHNOLOGY GROUP CO., LTD., Beijing (CN); BOE OPTICAL SCIENCE AND TECHNOLOGY CO., LTD., Suzhou, Jiangsu (CN)

( * ) Notice: Subject to any disclaimer, the term of this patent is extended or adjusted under 35 U.S.C. 154(b) by 190 days.

(21) Appl. No.: 14/908,794

(22) PCT Filed: Sep. 21, 2015

(86) PCT No.: PCT/CN2015/090099
§ 371 (c)(1),
(2) Date: Jan. 29, 2016

(87) PCT Pub. No.: WO2016/155264
PCT Pub. Date: Oct. 6, 2016

(65) Prior Publication Data

US 2017/0038011 A1 Feb. 9, 2017

(30) Foreign Application Priority Data

Mar. 30, 2015 (CN) ..... 2015 1 0144315

(51) Int. Cl.
*F21V 7/00* (2006.01)
*F21K 9/272* (2016.01)
(Continued)

(52) U.S. Cl.
CPC ..... *F21K 9/272* (2016.08); *F21K 9/278* (2016.08); *F21S 2/00* (2013.01); *F21S 8/04* (2013.01);
(Continued)

(58) Field of Classification Search
CPC . F21V 21/00; F21V 7/22; F21K 9/272; F21K 9/278; F21S 2/00; F21S 8/04
(Continued)

(56) References Cited

U.S. PATENT DOCUMENTS 2,194,841 A * 3/1940 Welch ..... F21V 7/005 362/217.05
2,250,276 A * 7/1941 Rutherford ..... H02G 3/0608 138/157
(Continued)

FOREIGN PATENT DOCUMENTS

CN 200986140 Y 12/2007
CN 201059479 Y 5/2008
(Continued)

OTHER PUBLICATIONS

International Search Report and Written Opinion both dated Dec. 21, 2015; PCT/CN2015/090099.
(Continued)

*Primary Examiner* — Anabel Ton
(74) *Attorney, Agent, or Firm* — Ladas & Parry LLP; Loren K. Thompson

(57) ABSTRACT

A lampholder and a luminaire are provided. The lampholder includes a recess, a base of which has a luminous unit installing side; and a reflecting flank, extending from the recess and having a reflecting face facing the luminous unit installing side. The luminaire includes the lampholder. With the lampholder and the luminaire, conventionally discrete lampholder and light reflecting shade are made into an
(Continued)

integral lampholder, so that structure is more simple, and the connecting step of a light emitting shade and a lampholder is cut down. In addition, the recess configuration of the lampholder is usable for accommodating an externally arranged power supply of a luminous unit, thereby saving the storage space, and reducing the warehousing and logistics costs.

15 Claims, 6 Drawing Sheets

(51) Int. Cl.

| | |
|---|---|
| ***F21S 2/00*** | (2016.01) |
| ***F21V 21/10*** | (2006.01) |
| ***F21K 9/278*** | (2016.01) |
| ***F21S 8/04*** | (2006.01) |
| ***F21V 7/22*** | (2018.01) |
| ***F21V 17/16*** | (2006.01) |
| ***F21V 23/02*** | (2006.01) |
| *F21Y 115/10* | (2016.01) |

(52) U.S. Cl.
CPC ..... *F21V 7/22* (2013.01); *F21V 17/16* (2013.01); *F21V 21/10* (2013.01); *F21V 23/02* (2013.01); *F21Y 2115/10* (2016.08)

(58) Field of Classification Search
USPC ..... 362/219, 217.02, 5–8
See application file for complete search history.

(56) References Cited

U.S. PATENT DOCUMENTS

| | | | | |
|---|---|---|---|---|
| 2,297,886 | A * | 10/1942 | Gustin | H05B 41/08 307/105 |
| 2,393,062 | A * | 1/1946 | Reeves | F21S 8/04 362/217.08 |
| 2,420,943 | A * | 5/1947 | Freeman | F21V 17/00 362/217.05 |
| 3,725,301 | A * | 4/1973 | Mueller, Jr. | C08G 18/4269 502/153 |
| 4,065,667 | A * | 12/1977 | Ruud | F21S 8/033 362/217.05 |
| 8,220,955 | B2 * | 7/2012 | Kwak | F21K 9/00 362/217.05 |
| 2008/0037239 | A1 | 2/2008 | Thomas et al. | |
| 2011/0022120 | A1 | 1/2011 | Ball et al. | |

FOREIGN PATENT DOCUMENTS

| | | | |
|---|---|---|---|
| CN | 201069111 | Y | 6/2008 |
| CN | 201293227 | Y | 8/2009 |
| CN | 102011964 | A | 4/2011 |
| CN | 102506339 | A | 6/2012 |
| CN | 103398334 | A | 11/2013 |
| CN | 103775863 | A | 5/2014 |
| CN | 104748085 | A | 7/2015 |

OTHER PUBLICATIONS

First Chinese Office Action dated Apr. 27, 2017; Appln. No. 201510144315.8.
The Second Chinese Office Action dated Sep. 18, 2017; Appln. 201510144315.8.

* cited by examiner

LAMPHOLDER AND LUMINAIRE

TECHNICAL FIELD

At least one embodiment of the present invention relates to a lampholder and a luminaire.

BACKGROUND

A luminaire is a kind of illuminating instruments widely used in modern society, and generally includes a lampholder and a luminous element mounted on the lampholder. FIG. 1 and FIG. 2 respectively illustrate a known single-tube luminaire and a double-tube luminaire. As illustrated in FIG. 1 and FIG. 2, this known luminaire generally includes a lampholder 3' configured for mounting a tube 1, a light reflecting shade 2 connected to the lampholder 3', and a lampstand 4 connected to two ends of the lampholder 3' and configured for holding two ends of the tube 1.

In this luminaire, the lampholder 3' is generally shaped to be a box with an opening so as to accommodate a fluorescent lamp, a ballast, etc., wherein, according to the number of tube 1, volume of the box can be adjusted; the light reflecting shade 2 is formed to have two flanks extending toward two sides and in the length direction of the tube 1 so as to reflect lights emitted by the tube 1.

FIG. 3 and FIG. 4 are side views of a single-tube or double-tube luminaire illustrated in FIG. 1 and FIG. 2, respectively. As illustrated in FIG. 3 and FIG. 4, upon installment, a lampholder 3' is firstly attached to an installing interface (e.g. ceiling, or the like) or installed onto the installing interface by way of screw locking or the like, and then a light reflecting shade 2 is fixedly connected to the lampholder 3'. Finally, a lampstand 4 is fixed to two ends of the lampholder 3' so as to hold a tube 1.

The aforesaid installation step is complicated; and moreover, the lampholder 3' needs to be produced separately and occupies a relatively large volume, thereby increasing production, warehousing and logistics costs.

SUMMARY

According to embodiments of the present invention, there is provided a lampholder, which includes a recess, a base of which has a luminous unit installing side; and a reflecting flank, extending from the recess and having a reflecting face facing the luminous unit installing side.

In an example, the recess has a sidewall extending from the base, and the reflecting flank extends from the sidewall.

In an example, a side of the base of the recess opposed to an opening side of the recess is the luminous unit installing side.

In an example, the base of the recess includes a light reflecting coating on a side of the base facing the luminous unit installing side.

In an example, the reflecting face of the reflecting flank includes a light reflecting coating so as to reflect lights to the luminous unit installing side.

In an example, the reflecting flank is in a camber shape which bends toward the luminous unit installing side as a whole.

In an example, section of the reflecting flank has a bent end.

In an example, a depth of the recess is in a range of 10 to 40 mm.

In an example, the sidewall is arranged in a symmetric manner centered on the base of the recess, and an angle between the sidewall and the base of the recess is larger than or equal to 90°.

In an example, the base of the recess is provided with at least one installing hole configured for fixing the lampholder and at least one wiring hole configured for running through of a wire.

In an example, two sides of the base of the recess are provided with clips configured for fixing wires.

In an example, a fixing part configured for fixing an externally arranged power supply is provided inside the recess.

According to an embodiment, there is further provided a luminaire, which includes the lampholder as stated by any of above-mentioned embodiments.

In an example, at the luminous unit installing side of the base of the recess of the lampholder, there is installed a luminous unit.

In an example, the luminous unit is installed at a side of the base of the recess that is opposed to an opening side of the recess.

In an example, inside the recess, there is installed an externally arranged power supply of the luminous unit.

In an example, the luminaire further includes lampstands, which are detachably connected to two ends of the lampholder so as to hold the luminous unit; the recess of the lampholder includes lampstand installing holes disposed at two ends of the base in its length direction; the lampstands include protrusive portions mated with the lampstand installing holes.

In an example, the lampstands are provided with at least one luminous unit socket configured for holding an end of the luminous unit.

With respect to the lampholder and luminaire provided by embodiments of the invention, conventionally discrete lampholder and light reflecting shade are made into one body, achieving functions of fixing a luminous unit and reflecting lights emitted by the luminous unit at the same time. By doing this, structure of the lampholder is more simple, the manufacturing process is simplified, and material cost and production cost are reduced. Upon installation, the only thing to do is to fix the lampholder to an installing face, and the connecting step of a light emitting shade and a lampholder in the known technology is cut down. In addition, the aforesaid recess configuration of the lampholder is usable for accommodating an externally arranged power supply of a luminous unit (e.g. a LED lamp or the like); as for a LED lamp with a built-in power supply inside the tube, the recess also facilitates lamination, thereby saving the storage space, and reducing the warehousing and logistics costs.

BRIEF DESCRIPTION OF THE DRAWINGS

Embodiments of the present invention will be described below in more detail in conjunction with attached drawings, so that the present invention is understood by those ordinarily skilled in the art more clearly. In the drawings.

REFERENCE NUMERALS

1. tube; 2. light reflecting shade; 3'. lampholder; 3. lampholder; 31. lampstand installing hole; 32. installing hole; 33. wiring hole; 34. clip; 4. lampstand; 41. socket for luminous unit; 42. protrusive portion; 5. recess; 51. base; 52. sidewall; 6. reflecting flank.

DETAILED DESCRIPTION

Hereinafter, the technical solutions in the embodiments of the present disclosure will be described in a clearly and fully understandable way in connection with the drawings in the embodiments of the present disclosure. It is obvious that the described embodiments are just a part but not all of the embodiments of the present disclosure. Based on the embodiments in the present disclosure, those ordinarily skilled in the art can obtain other embodiment(s), without any inventive work, which should be within the scope sought for protection by the invention.

Unless otherwise defined, the technical terminology or scientific terminology used herein should have the same meaning as commonly understood by one of ordinary skill in the art to which this invention belongs. "First", "second" and the like used in the specification and claims of patent application of the present disclosure do not show any order, number or importance, but are only used to distinguish different constituent parts. Likewise, term "a," "an," or the like does not indicate limitation in number, but specifies the presence of at least one. A term "connection," "coupled" or the like is not limited to physical or mechanical connection, but can include electrical connection, whether directly or indirectly. "Upper," "lower," "left", "right" or the like is only used to describe a relative positional relationship, and when an absolute position of the described object is changed, the relative positional relationship might also be changed accordingly.

Hereinafter, specific embodiments of the present invention will be further described in detail, and wherein, in order to make a clearer description, some traits and structures are omitted herein, but this describing manner does not indicate that in embodiments of the invention, only the described traits and structures are contained. Thus, it can also include other needful traits and structures.

Embodiment 1

According to the present embodiment, there is provided a lampholder, which mainly includes a recess, a base of which has a luminous unit installing side; and a reflecting flank, which extends from the recess and has a reflecting face facing the luminous unit installing side.

Figure 1:
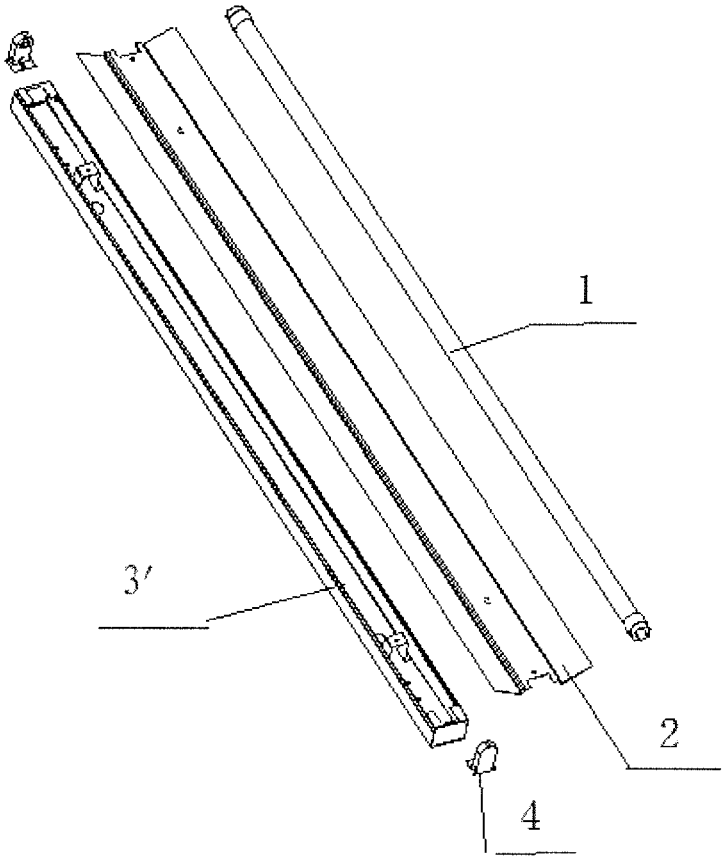
FIG. 1 is a structurally schematic view illustrating a single-tube luminaire in the known technology.
Figure 2:
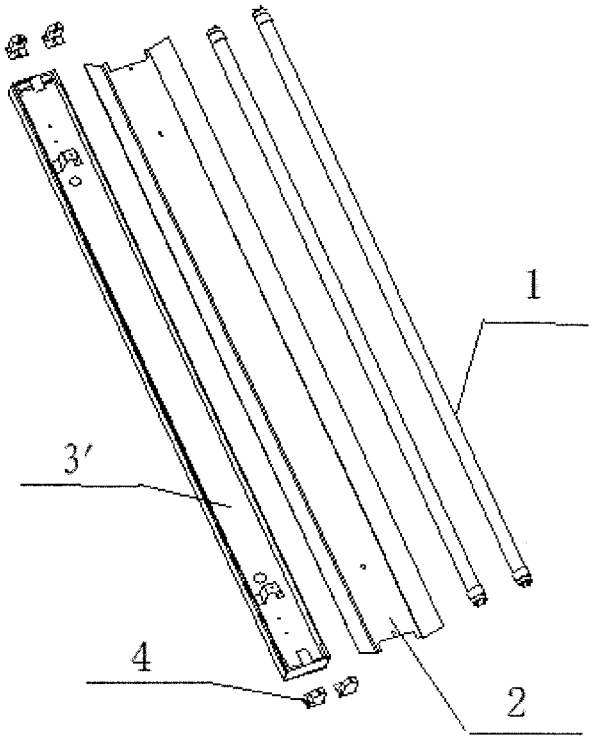
FIG. 2 is a structurally schematic view illustrating a double-tube luminaire in the known technology.
Figure 3:
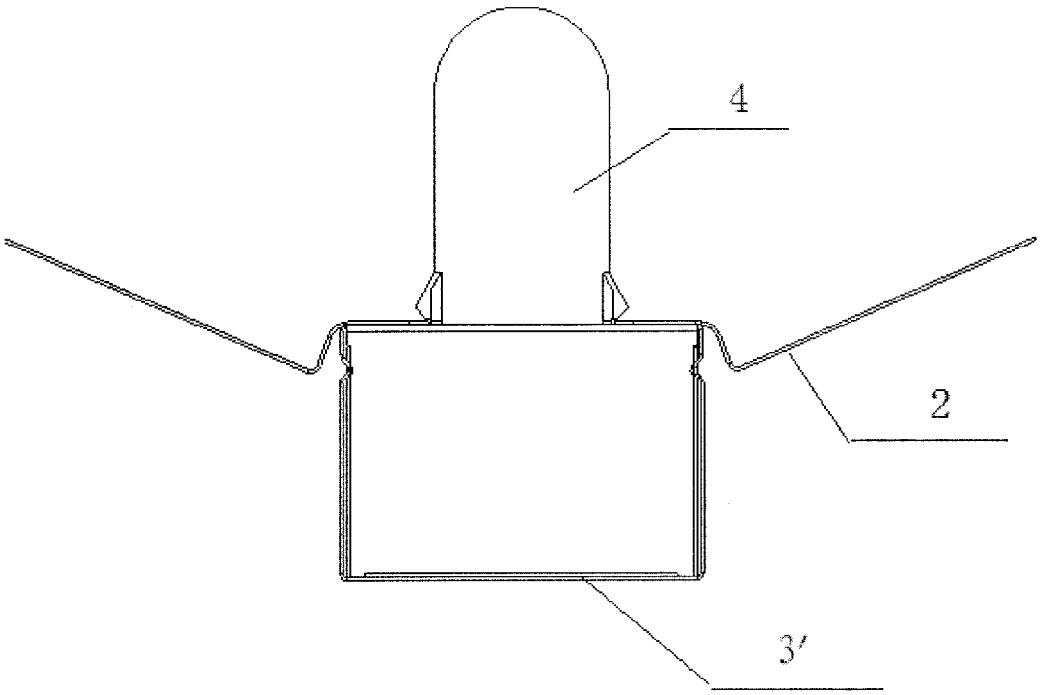
FIG. 3 is a schematically, structurally side view illustrating a single-tube luminaire in the known technology.
Figure 4:
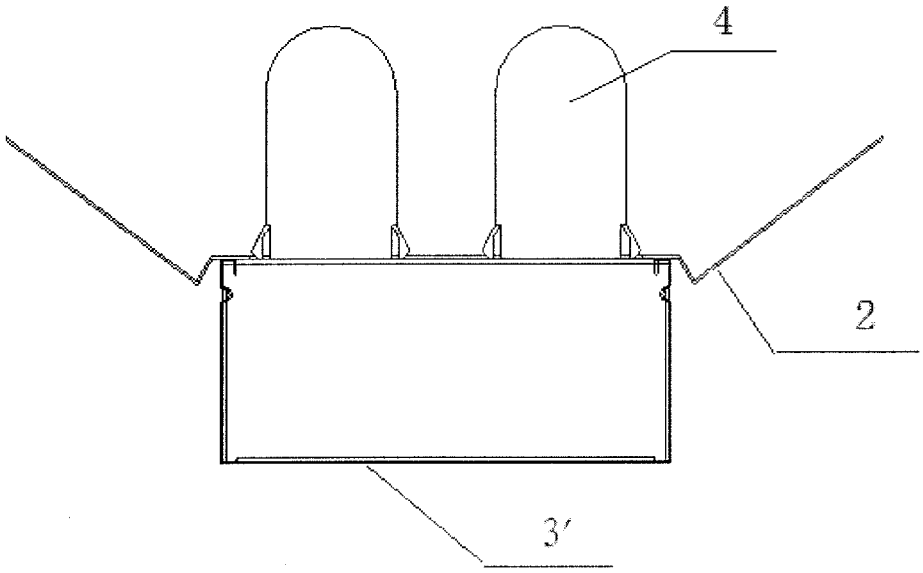
FIG. 4 is a schematically, structurally side view illustrating a double-tube luminaire in the known technology.
Figure 5:
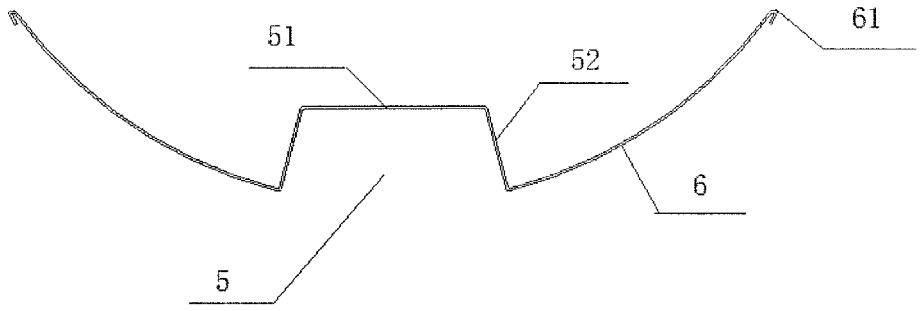
FIG. 5 is a schematically, structurally side view illustrating a lampholder in Embodiment 1 of the present invention.

An example of the lampholder according to embodiments of the invention is illustrated in FIG. 5. A lampholder 3 includes a recess 5 including a base 51, one of two sides of which is configured to be a luminous unit installing side at which a luminous unit is installable; and reflecting flanks 6 extending from the recess 5, faces of the reflecting flanks 6 facing the luminous unit installing side being usable for reflecting lights emitted by the luminous unit.

In the present example, sidewalls 52 of the recess 5 extend from two opposite sides of the base 51, while the reflecting flanks 6 extend from the sidewalls 52.

As stated above, with the lampholder according to the embodiment, conventionally discrete lampholder and light reflecting shade are formed into an integral lampholder, achieving functions of fixing a luminous unit and reflecting lights emitted by the luminous unit at the same time. By doing this, structure of the lampholder is more simple, the manufacturing process is simplified, and material cost and production cost are reduced. Upon installation, the only thing to do is to fix the lampholder 3 to an installing face such as ceiling, and the connecting step of a light emitting shade and a lampholder that is requisite conventionally is cut down. In addition, the aforesaid configuration of recess 5 of the lampholder 3 is usable for accommodating an externally arranged power supply of a luminous unit (e.g. a LED lamp or the like); as for a LED lamp with a built-in power supply inside the tube, the recess 5 also facilitates lamination, thereby saving the storage space, and reducing the warehousing and logistics costs.

In embodiments of the present invention, the lampholder 3 has a luminous unit installing side and a back side that is opposite the luminous unit installing side; in one example, one side of the base 51 of the recess 5 that is opposed to an opening side of the recess 5 is the luminous unit installing side, and is configured for installing a luminous unit such as a LED lamp tube 1. As such, when the LED lamp tube 1 is such as an externally powered type, the internal space of the recess 5 is usable for accommodating an externally arranged power supply of the LED lamp tube 1, so that the luminous unit and its externally arranged power supply are disposed on two sides of the lampholder 3, respectively. It should be understood that, if an opening side of the recess 5 is just the luminous unit installing side, then accordingly, the internal space of the recess 5 is configured for accommodating the lamp tube 1.

In one example, the base 51 of the recess 5 includes a light reflecting coating on one side of it facing a luminous unit installing side. With the light reflecting coating, lights emitted by a lamp tube 1 can be reflected.

In embodiments of the invention, the lampholder 3 has a luminous unit installing side and a back side that is opposite the luminous unit installing side. Accordingly, the reflecting flank 6 includes a light reflecting coating on that face of it facing the luminous unit installing side, and thus, the reflecting flank 6 can act to reflect lights emitted by the luminous unit to the luminous unit installing side of the lampholder 3.

In one example, a light reflecting coating of the reflecting flank 6 and a light reflecting coating of the base 51 of the recess 5 can be manufactured together with the reflecting flank 6, so as to cut down the procedure.

In one example, a reflecting flank 6 has a camber shape which is bent toward the luminous unit installing side as a whole, and this is more propitious to light reflection. It should be understood that, the above radian of the reflecting flank 6 may be adjusted according to actual application situations, and the only thing to do is to change the radian of a shaping mold.

In one example, depth of the recess 5 is in the range of 10 to 40 mm. In embodiments of the present invention, the depth of the recess 5 refers to a distance between a base 51 of the recess 5 and an opening of the recess 5. In actual applications, the range of depth of a recess 5 can be controlled so as to be adapted to the size of an externally arranged power supply of a luminous unit and the distance to an installing interface.

In one example, sidewalls 52 of the recess 5 are symmetrically disposed centered on the base 51. When a luminous unit installing side of a lampholder 3 is a side of the base 51 opposed to an opening side of the recess 5, the angle between the sidewalls 52 and the base 51 may be larger than or equal to 90°. As such, width of an opening of the recess 5 is larger than width of the base 51 of the recess 5, and this is more propitious to embedment and installment of an externally arranged power supply of a luminous unit. Accordingly, two reflecting flanks 6 extend from the two sidewalls 52 so as to be symmetrically disposed centered on the recess 5. By doing this, the luminescence can be more concentrated, and this is propitious to enhancing the brightness of an illuminated zone.

Figure 6:
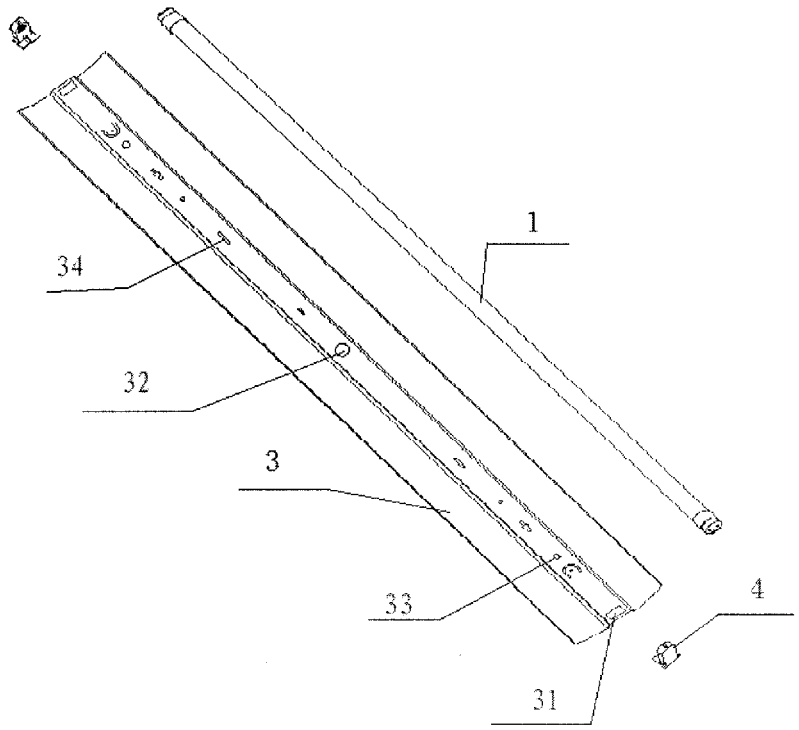
FIG. 6 is a structurally schematic view illustrating a lampholder and other components constituting a single-tube luminaire in Embodiment 1 or Embodiment 2 of the invention.
Figure 7:
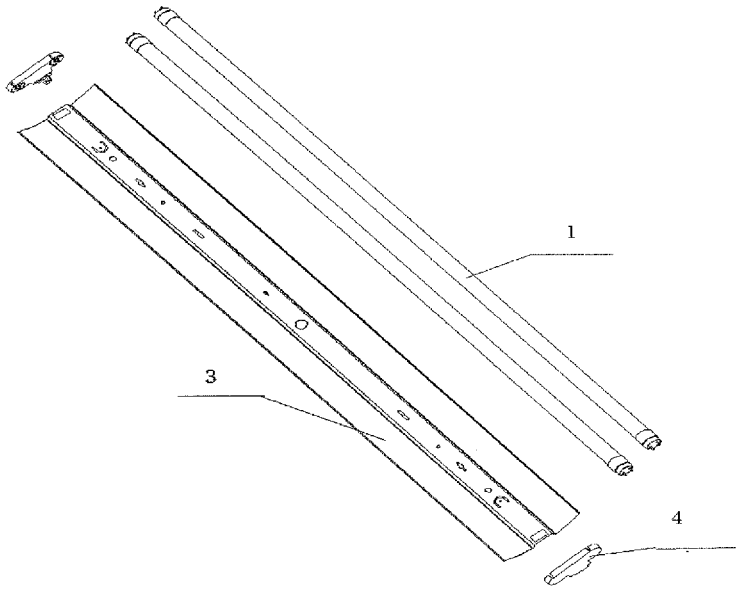
FIG. 7 is a structurally schematic view illustrating a lampholder and other components constituting a double-tube luminaire in Embodiment 1 or Embodiment 2 of the invention.

As illustrated in FIG. 6 and FIG. 7, in one example, a base 51 of the recess 5 is provided with at least one installing hole 32 for fixing the lampholder 3 and at least one wiring hole 33 for wirings. The position and number of aforesaid installing hole 32 and wiring hole 33 may be set according to specific requirements, and no limit will be set here.

In embodiments of the invention, it is possible that installment of a lampholder 3 is achieved by fixing the lampholder 3 to an installing interface (e.g., ceiling) with the aid of the aforesaid installing hole 32. When the luminous unit installing side of the lampholder 3 is a side of a base 51 opposed to an opening side of a recess 5, an enclosed space is formed by the opening side of the recess 5 and the installing interface, and an externally arranged power supply of a LED lamp tube may be accommodated within the enclosed space.

In one example, a fixing bolt or clip for fixing the aforesaid externally arranged power supply may be provided on sidewalls 52 or a base 51 of a recess; it should be understood that, any scheme in which an externally arranged power supply is installed in a place that is not in conflict with an installing hole 32 is feasible, and no limit will be set here.

In one example, as illustrated in FIG. 6, two sides of a base 51 of the recess 5 are provided with clips 34 for putting wirings in order. By doing this, wirings for control or power supply of a luminous unit can be more regular.

In diverse examples, section of the reflecting flank 6 may be a straight line, and may also be a curve. It should be understood that, the shape and curvature of the reflecting flank 6 may be adjusted according to size of luminous radiation zone.

In one example, section of the reflecting flank 6 is a straight line with a bent end or a curve with a bent end. In view of the fact that when an end of a reflecting flank 6 is a pointed tip or a flat tip with a relatively sharp edge, there may be a risk of pricking or piercing a person or an article in contact with it, in the event that section of a reflecting flank 6 is a straight line with a bent end or a curve with a bend end, its end has a bent-back portion to form a smooth contact face, and thus the risk of pricking or piercing a person or an article in contact with it is reduced.

Embodiment 2

As illustrated in FIGS. 6 to 9, according to the present embodiment, there is provided a luminaire, which includes any of the lampholders as described in the aforesaid Embodiment 1.

As stated above, with the luminaire according to the embodiment, conventionally discrete lampholder and light reflecting shade are formed into an integral lampholder, achieving functions of fixing a luminous unit and reflecting lights emitted by the luminous unit at the same time. By doing this, structure of the lampholder is more simple, the manufacturing process is simplified, and material cost and production cost are reduced. Upon installation, the only thing to do is to fix the lampholder 3 to an installing face such as ceiling, and the connecting step of a light emitting shade and a lampholder that is requisite conventionally is cut down. In addition, the aforesaid configuration of recess 5 of the lampholder 3 is usable for accommodating an externally arranged power supply of a luminous unit (e.g. a LED lamp or the like); as for a LED lamp with a built-in power supply inside the tube, the recess 5 also facilitates lamination, thereby saving the storage space, and reducing the warehousing and logistics costs.

In one example, the luminaire further includes lampstands 4 that are detachably connected to two ends of the lampholder 3, for holding a luminous unit;

For example, as illustrated in FIG. 6, a recess 5 of the lampholder 3 may include a lampstand installing holes 31 disposed at two ends of the base 51 in the length direction; accordingly, the lampstand 4 may include a protrusive portion 42 mated with the lampstand installing hole 31, so as to detachably connect the lampstand 4 and the lampholder 3.

Figure 8:
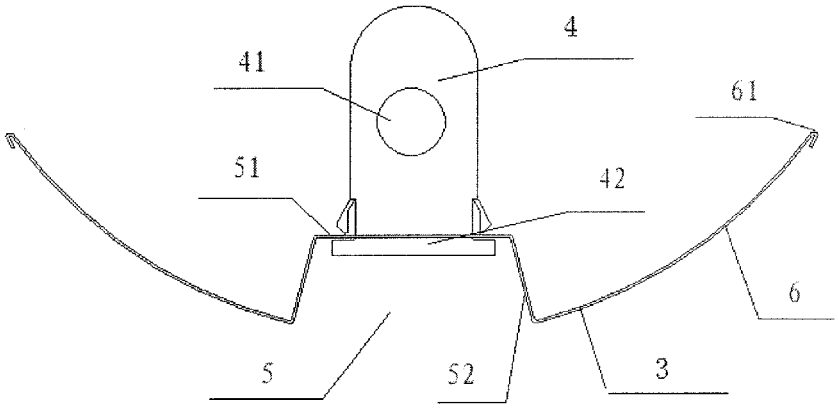
FIG. 8 is a schematically, structurally side view illustrating a single-tube luminaire in Embodiment 2 of the present invention.
Figure 9:
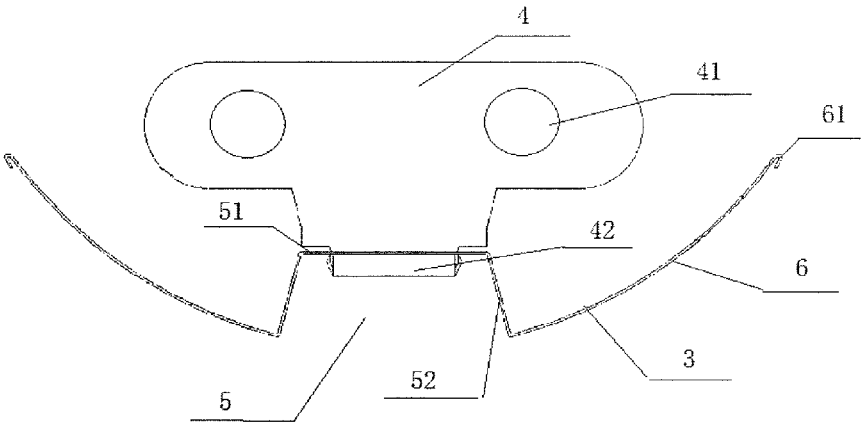
FIG. 9 is a schematically, structurally side view illustrating a double-tube luminaire in Embodiment 2 of the present invention.

In one example, as illustrated in FIGS. 8 to 9, the lampstand 4 is provided with at least one luminous unit socket 41 configured for holding an end of the luminous unit. When a multiple-tube luminous unit is adopted, the corresponding quantity of sockets may be provided on a lampstand 4, and holding of each tube can be accomplished. By means of replacing the lampstands 4, changeover between a multiple-tube luminous unit and a single-tube luminous unit can be realized.

It can be understood that, the aforesaid embodiments are merely exemplary embodiments used for explaining the principle of the present invention, but the present invention is not limited thereto. For those ordinarily skilled in the art, various variants or improvements can be made without departing from the spirit and essence of the invention, and these variants and improvements shall be deemed as the protection scope of the invention.

This application claims the benefit of priority from Chinese patent application No. 201510144315.8, titled as "a lampholder and luminaire", filed on Mar. 30, 2015, the disclosure of which is incorporated herein in its entirety by reference as a part of the present application.

The invention claimed is:

1. A lampholder, comprising a recess comprising a base and sidewalls, the base having a first side and a second side, the side walls being extending from the first side in a direction away from the second side, and the second side being a luminous unit installing side; and a reflecting flank, extending from ends of the sidewalls of the recess far away from the base and having a reflecting face facing the luminous unit installing side, the base of the recess is provided with at least one installing hole configured for fixing the lampholder and at least one wiring hole configured for running through of a wire.

2. The lampholder according to claim 1, wherein, a side of the base of the recess opposed to an opening side of the recess is the luminous unit installing side.

3. The lampholder according to claim 1, wherein, the base of the recess includes a light reflecting coating on a side of the base facing the luminous unit installing side.

4. The lampholder according to claim 1, wherein, the reflecting face of the reflecting flank includes a light reflecting coating so as to reflect lights to the luminous unit installing side.

5. The lampholder according to claim 1, wherein, the reflecting flank is in a camber shape which bends toward the luminous unit installing side as a whole.

6. The lampholder according to claim 1, wherein, the recess has a depth in a range of 10 to 40 mm.

7. The lampholder according to claim 1, wherein, the sidewall is arranged in a symmetric manner centered on the base of the recess, and an angle between the sidewall and the base of the recess is larger than or equal to 90°.

8. The lampholder according to claim 1, wherein, two sides of the base of the recess are provided with clips configured for fixing wires.

9. The lampholder according to claim 1, wherein, a fixing part configured for fixing an externally arranged power supply is provided inside the recess.

10. A luminaire, characterized by that, it includes the lampholder according to claim 1.

11. The luminaire according to claim 10, wherein, at the luminous unit installing side of the base of the recess of the lampholder, there is installed a luminous unit.

12. The luminaire according to claim 11, wherein, the luminous unit is installed at a side of the base of the recess that is opposed to an opening side of the recess.

13. The luminaire according to claim 12, wherein, inside the recess, there is installed an externally arranged power supply of the luminous unit.

14. The luminaire according to claim 11, further comprising lampstands, which are detachably connected to two ends of the lampholder and configured for holding the luminous unit;

the recess of the lampholder includes lampstand installing holes disposed at two ends of the base in its length direction;

the lampstands include protrusive portions mated with the lampstand installing holes.

15. The luminaire according to claim 11, wherein, the lampstands are provided with at least one luminous unit socket for holding an end of the luminous unit.

* * * * *